US008851715B2

(12) United States Patent
Payne et al.

(10) Patent No.: US 8,851,715 B2
(45) Date of Patent: Oct. 7, 2014

(54) LAMP VENTILATION SYSTEM

(75) Inventors: David G. Payne, Beaverton, OR (US); Sara Jennings, Hillsboro, OR (US)

(73) Assignee: Phoseon Technology, Inc., Hillsboro, OR (US)

( * ) Notice: Subject to any disclaimer, the term of this patent is extended or adjusted under 35 U.S.C. 154(b) by 308 days.

(21) Appl. No.: 13/350,550

(22) Filed: Jan. 13, 2012

(65) Prior Publication Data

US 2013/0182436 A1 Jul. 18, 2013

(51) Int. Cl.
*F21V 29/02* (2006.01)

(52) U.S. Cl.
USPC ..... 362/373; 362/294

(58) Field of Classification Search
CPC ..... F21V 29/004; F21V 29/02; F21V 29/025; F21V 29/027
USPC ..... 313/46; 362/373, 218, 249.1, 249.01, 362/294
See application file for complete search history.

(56) References Cited

U.S. PATENT DOCUMENTS

| | | | |
|---|---|---|---|
| 5,857,767 | A | 1/1999 | Hochstein |
| 5,936,353 | A | 8/1999 | Triner et al. |
| 6,200,134 | B1 | 3/2001 | Kovac et al. |
| 6,457,823 | B1 | 10/2002 | Cleary et al. |
| 6,501,084 | B1 | 12/2002 | Sakai et al. |
| 6,575,599 | B1 | 6/2003 | Imamura et al. |
| 6,683,421 | B1 | 1/2004 | Kennedy et al. |
| 6,692,250 | B1 | 2/2004 | Decaudin et al. |
| 2001/0046652 | A1 | 11/2001 | Ostler et al. |
| 2002/0187454 | A1 | 12/2002 | Melikechi et al. |
| 2003/0043582 | A1 | 3/2003 | Chan et al. |
| 2003/0081096 | A1 | 5/2003 | Young |
| 2010/0302769 | A1 | 12/2010 | Horng et al. |
| 2011/0170287 | A1 | 7/2011 | Medinis |
| 2012/0106173 | A1* | 5/2012 | Yoneda et al. ..... 362/373 |

FOREIGN PATENT DOCUMENTS

| | | | |
|---|---|---|---|
| DE | 19619154 | A1 | 6/1997 |
| DE | 10127171 | A1 | 12/2001 |
| EP | 0879582 | A1 | 11/1998 |
| EP | 1158761 | A1 | 11/2001 |
| EP | 1599340 | B1 | 9/2007 |

(Continued)

OTHER PUBLICATIONS

Korean Intellectual Property Office, International Search Report and Written Opinion of PCT/US2013/021046, ISA Korea, Apr. 26, 2013, 10 pages.

(Continued)

*Primary Examiner* — Karabi Guharay
(74) *Attorney, Agent, or Firm* — Alleman Hall McCoy Russell & Tuttle LLP

(57) ABSTRACT

A lighting module has a housing that houses an array of light-emitting elements and has multiple channels that each have an opening at the end of each channel. All of the openings of the channels are positioned along the same plane in some examples. The plane is opposite the surface of the housing that emits the light from the light-emitting elements. An intake fan is positioned in at least one of the channels so that it causes air to enter the housing through that channel's opening. An exhaust fan is positioned in another one of the channels so that it causes air to be forced out of the housing through the other channel's opening. The air flow through the intake channel and the exhaust channel help cool the lighting module during use.

20 Claims, 6 Drawing Sheets

(56) References Cited

FOREIGN PATENT DOCUMENTS

| | | | |
|---|---|---|---|
| JP | 2008293817 | A | 12/2008 |
| JP | 2011154855 | A | 8/2011 |
| WO | 9507731 | A1 | 3/1995 |
| WO | 0059671 | A1 | 10/2000 |
| WO | 0067048 | A2 | 11/2000 |
| WO | 0211640 | A2 | 2/2002 |
| WO | 0213231 | A2 | 2/2002 |
| WO | 03023875 | A2 | 3/2003 |
| WO | 2011038545 | A1 | 4/2011 |

OTHER PUBLICATIONS

Data Sheet for G*SiC Technology Super Blue LEDs No. C430-CB290-E1200, manufactured by Opto Semiconductors, May 1, 1999, 8 pages.
Data Sheet for 5.0 mm Blue Series LEDs No. LNG992CFB, manufactured by the Panasonic Corporation, Mar. 2001, 1 page.
Data Sheet for 3.0 mm Blue Series LEDs No. LNG997CKB, manufactured by the Panasonic Corporation, Mar. 2001, 1 page.
Data Sheet for G*SiC Technology Ultraviolet LEDs No. C395-MB290-E0400, manufactured by Cree, Inc., 2 pages.

* cited by examiner

LAMP VENTILATION SYSTEM

BACKGROUND

Solid-state light emitters, such as light emitting diodes (LEDs) and laser diodes, have several advantages over using more traditional arc lamps during curing processes, such as ultraviolet (UV) curing processes. Solid-state light emitters generally use less power, generate less heat, produce a higher quality cure, and have higher reliability than the traditional arc lamps. Some modifications increase the effectiveness and efficiency of the solid-state light emitters even further.

While solid-state light emitters emit less heat than their arc lamp counterparts, the temperatures emitted from the solid-state light emitters are still very high and can cause overheating of the solid-state light emitters during use and damage to the components of the solid-state light emitters over time. Overheating and damage to the components of the solid-state light emitters causes significant amounts of downtime for repair and loss of revenue.

Some solid-state light emitters try to incorporate cooling systems to remove some of the heat that is generated when the solid-state light emitter emits light. Oftentimes, these cooling systems include ventilation systems that have air intake and/or air exhaust openings positioned near the window through which light is emitted from the solid-state light emitter. This configuration positions the ventilation openings and causes air movement near the item(s) being cured. When ink is being cured on a medium, for example, this air movement disturbs the ink curing process and decreases the precision of positioning ink on the medium. These cooling systems tend to require large perimeters of space around the solid-state light emitters and prevent multiple solid-state light emitters from being stacked next to each other or on top of each other. Because of the ventilation challenges and the space restrictions for the solid-state light emitters, the light curing process is sometimes inefficient and expensive.

Most current solid-state light emitters do not address the ventilation challenges and the space restrictions of the current cooling systems and result in expensive and inefficient curing processes.

DETAILED DESCRIPTION OF THE EMBODIMENTS

Figures 1, 2, 3:
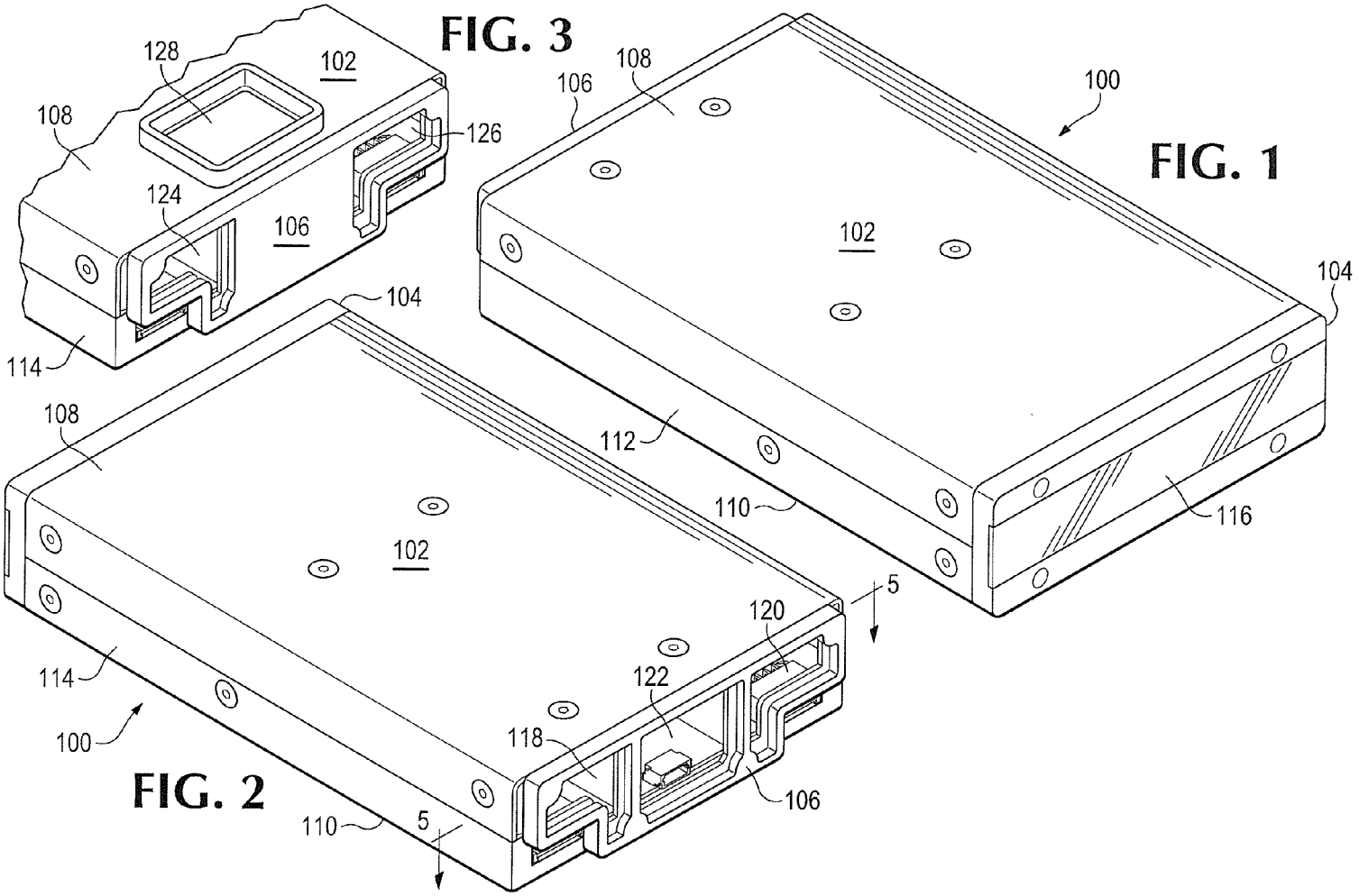
FIG. 1 shows a front perspective view of a lighting module, according to aspects of the disclosure.
FIG. 2 shows a back perspective view of the lighting module of FIG. 1 that shows openings to three channels in the housing.
FIG. 3 shows an alternative embodiment of the lighting module of FIG. 2 in which openings to two of the channels are positioned on the back surface of the housing and the opening to the third channel is located on the top surface of the housing.

FIGS. 1 and 2 show front and back perspective views, respectively, of a lighting module 100 having a housing 102 and an array of light-emitting elements positioned within the housing 102. Although the housing 102 can take any suitable shape, the housing 102 shown in FIGS. 1 and 2 is a rectangular box having a front surface 104, an opposing back surface 106, a top surface 108, an opposing bottom surface 110, and two opposing side surfaces 112, 114. The array of light-emitting elements emits light through a window 116 on the front surface 104 of the housing 102. The opposite, back surface 106 of the housing 102 defines a plane on which three openings 118, 120, 122 are positioned that correspond to three adjacent channels defined within the housing 102. The two outer openings 118, 120 correspond to air intake channels within the housing while the middle opening 122 corresponds to an air exhaust channel.

FIG. 3 shows an alternative embodiment in which two channel openings 124, 126 are positioned on the back surface 106 of the housing 102 and a third channel opening 128 is positioned on the top surface 108 of the housing 102 near the end of the top surface 108 closest to the back surface 106 of the housing 102. In this example, the two channel openings 124, 126 on the back surface 106 correspond to two air intake channels within the housing while the third channel opening on the top surface 108 corresponds to an air exhaust channel. In both examples shown in FIGS. 2 and 3, the air exhaust channel is positioned between the two air intake channels and all three channels are adjacent and parallel to each other.

Figure 4:
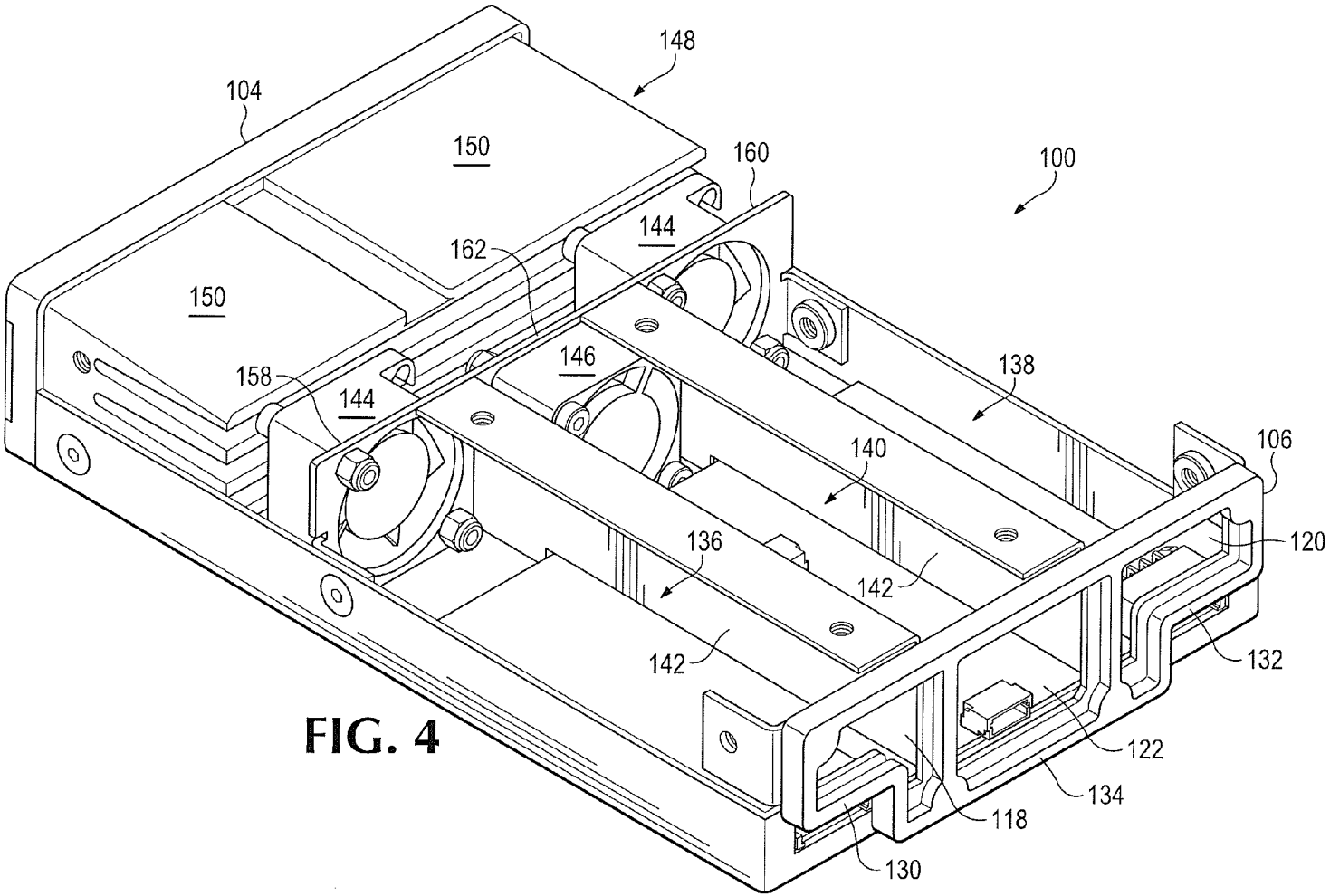
FIG. 4 shows the interior of the housing of the lighting module shown in FIGS. 1 and 2.

The openings 118, 120, 122 in FIG. 4 are all located on the same plane at respective ends 130, 132, 134 of the channels 136, 138, 140 defined in the housing 102. Three channels 136, 138, 140 are defined in the lighting module 100 shown in FIG. 4, although any suitable number of channels may be included in alternative examples. The lighting module 100 of FIG. 4 shows three, parallel and adjacent channels 136, 138, 140, each having respective openings 118, 120, 122 at one end 130, 132, 134. The channels 136, 138, 140 are separated by partitions 142 in the example shown in FIG. 4, although the channels 136, 138, 140 may be separated by any other suitable structure in alternative configurations.

The partitions 142 extend from the interior of the bottom surface 110 to the interior of the top surface 108 of the housing 102, which creates enclosed channels through which air flows. The air entering the air intake channels 136, 138 is generally cooler than the air forced out of or generally expelled from the air exhaust channel 140 and the mixing of air entering and exiting channels 136, 138, 140 is undesired. The partitions 142 separate the channels 136, 138, 140 and prevent air from mixing between the channels 136, 138, 140 within the housing 102. The volume of each channel 136, 138, 140 is approximately equal or the same in the lighting module 100 shown in FIG. 4, although the channels' volume may be different in alternative configurations.

All of the openings 118, 120, 122 in the example shown in FIG. 4 are positioned along the plane defined by the back surface 106 of the housing 102. The two outer channels are air intake channels 136, 138 and have one intake fan 144 positioned within each of their respective channels 136, 138 such that each intake fan 144 causes air to enter each of these channels 136, 138 through their respective openings 118, 120 on the back surface 106 of the housing 102. The air intake fans 144 force the air that enters through the first intake opening 118 through the first, intake channel 136 and into a light-emitting element portion 148 of the housing where the array of light-emitting elements is housed along with a heat sink 150.

Figure 5:
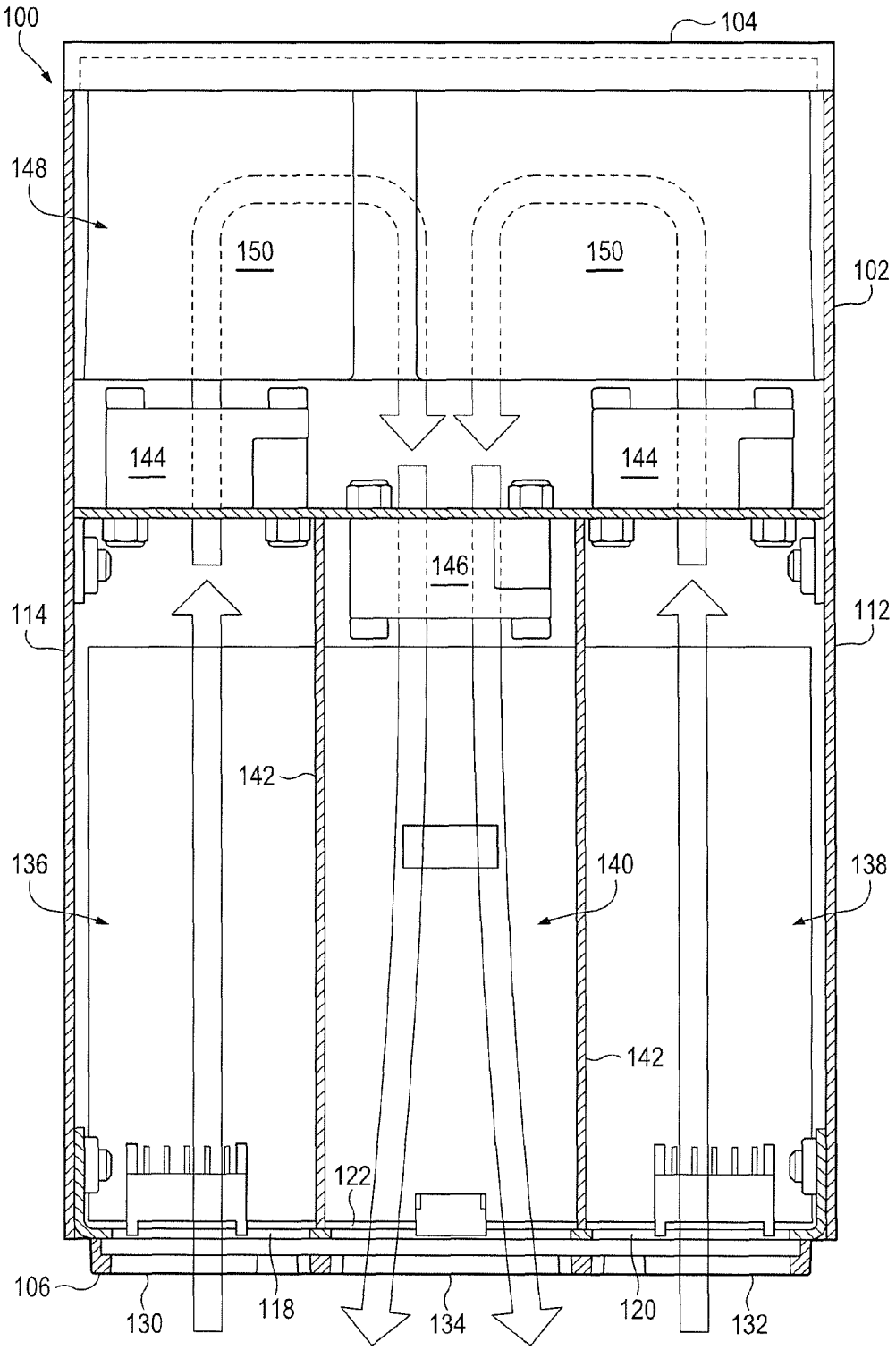
FIG. 5 shows a top view of the airflow pattern into and out of the housing of the lighting module illustrated in FIGS. 1 and 2.

The housing 102 is generally divided into two portions, the light-emitting element 148 portion that houses the array of light-emitting elements and the heat sink and a channel portion that includes all of the channels 136, 138, 140. The heat sink 150 transforms the heat generated by the array of light-emitting elements into air. The air from the intake channels 136, 138 is forced over and cools the hot air created by the heat sink 150 and exits the light-emitting element portion 148 through the middle, exhaust channel 140. An exhaust fan 146 located in the exhaust channel 140 forces air out of the light-emitting element portion 148 through the exhaust channel 140 and out of the lighting module 100 through the exhaust channel's opening 122. The arrows in FIG. 5 show this air flow pathway through the lighting module 100.

Figure 6:
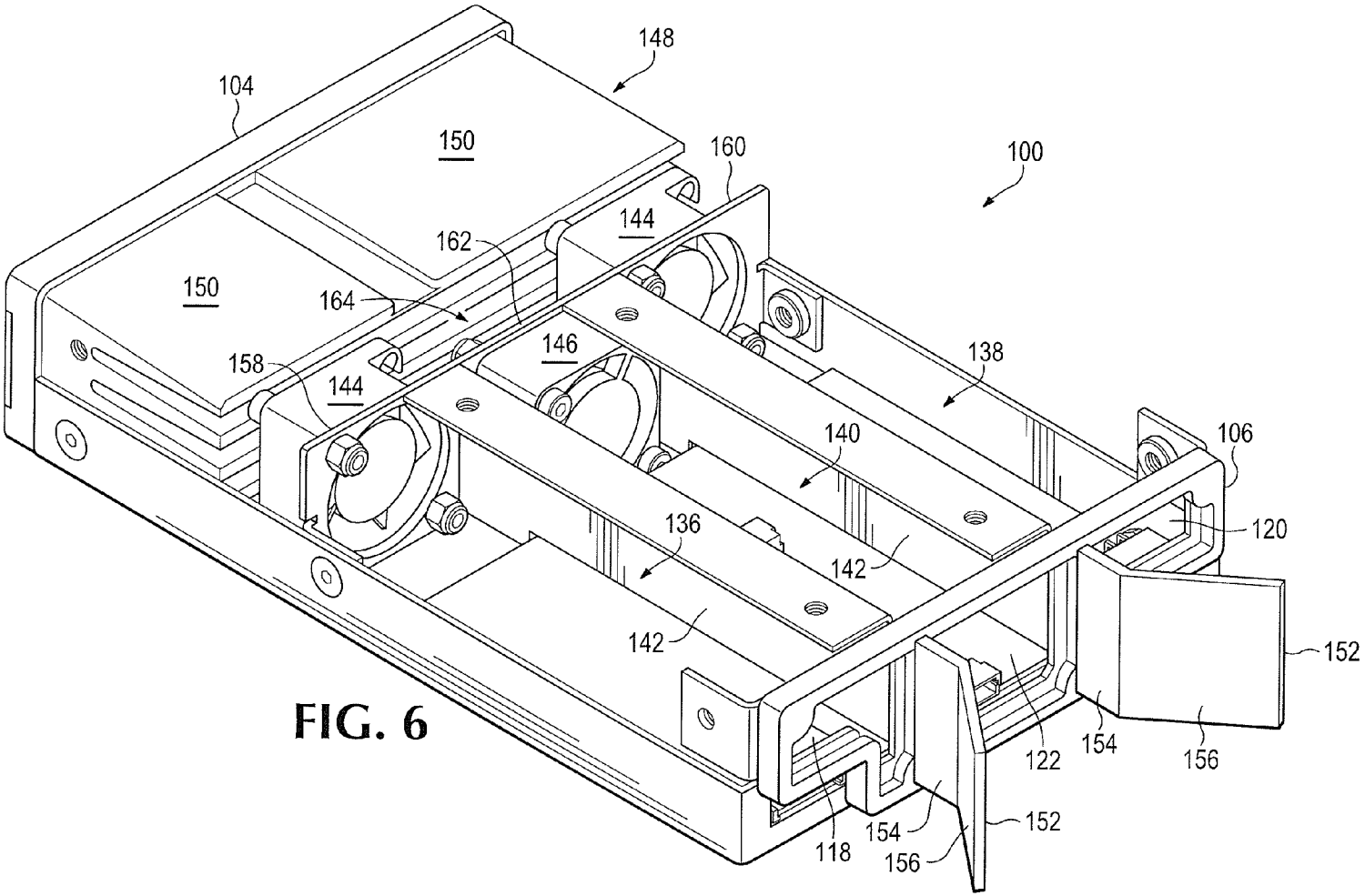
FIG. 6 shows the lighting module of FIGS. 1, 2, 4, and 5 with baffles between the openings of the channels, according to aspects of the disclosure.

FIG. 6 shows the lighting module 100 shown in FIG. 4 with the addition of two baffles 152 that are positioned between each opening 118, 120, 122, although any number of baffles may be included. In this example, the baffles 152 separate the air intake openings 118, 120 from the air exhaust opening 122 to further prevent mixing of the warm or hot air that is forced out of or expelled from the air exhaust channel 140 through its opening 122 with the cooler air that enters through the air intake openings 118, 120 and into the air intake channels 136, 138. The baffles 152 are any suitable shape and size. In FIG. 6, the baffles 152 have two surfaces 154, 156 that are angled with respect to each other.

Figure 7:
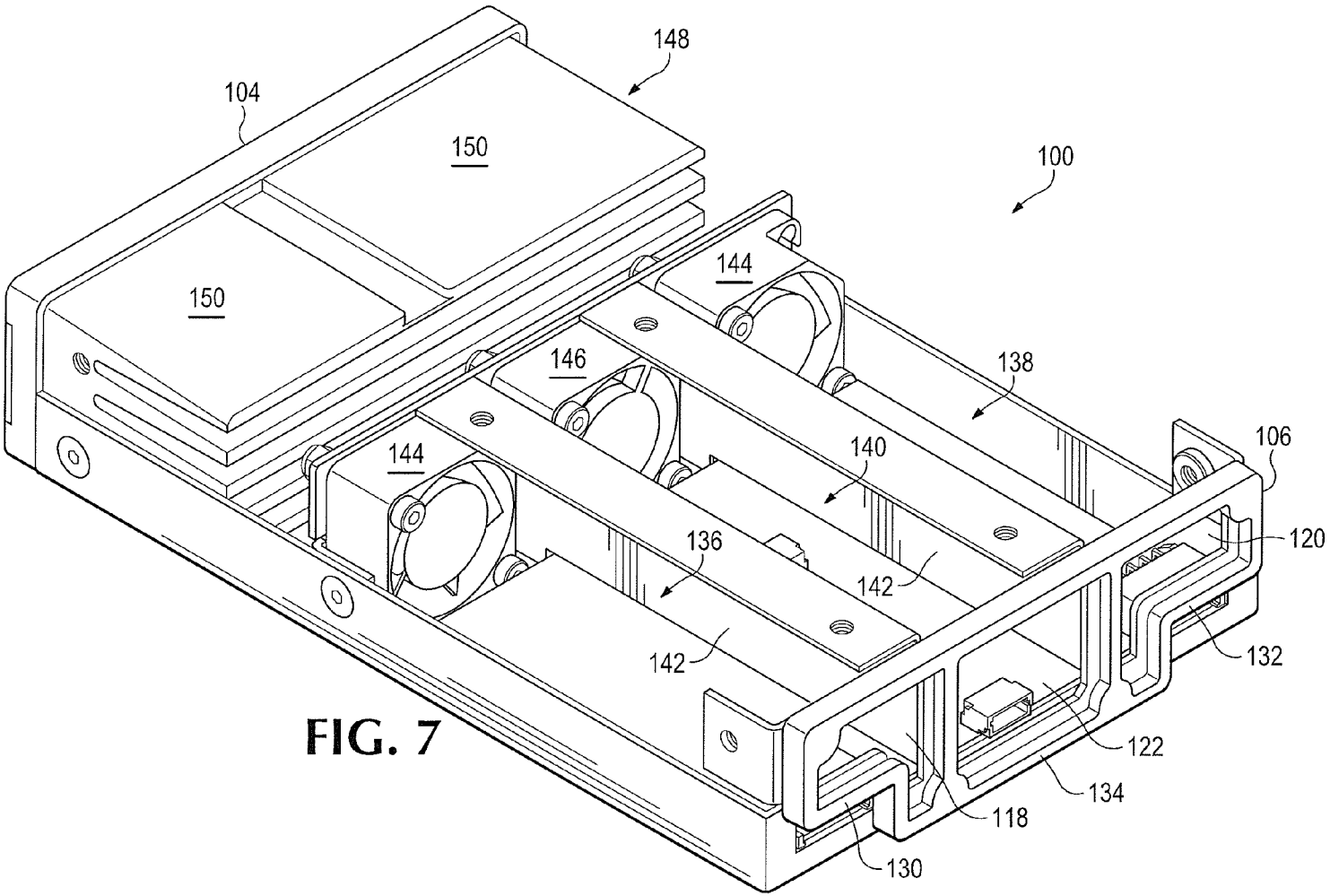
FIG. 7 shows an alternative embodiment of the lighting module, according to aspects of the disclosure.

The intake 144 and exhaust 146 fans are positioned within each of their respective channels 136, 138, 140. In FIG. 4, the two air intake fans 144 are aligned with each other and are positioned at the ends 158, 160 of the channels 136, 138 that are opposite the air intake openings 118, 120. The air exhaust fan 146 is positioned near, although spaced apart from the end 162 of the channel 140 that is opposite the air exhaust opening 122 and defines a gap 164 between the air exhaust fan 146 and the end 162 of the air exhaust channel 140. In this configuration, the two air intake fans 144 are offset from or otherwise not in alignment with the air exhaust fan 146. Alternatively, the two air intake fans 144 and the exhaust fan 146 are all aligned with each other at the end 158, 160, 162 of their respective channels 136, 138, 140 that is opposite their respective openings 118, 120, 122, as shown in FIG. 7. The fans may be aligned or offset from each other in any suitable manner and any number of fans may be included in the lighting module.

Figure 8:
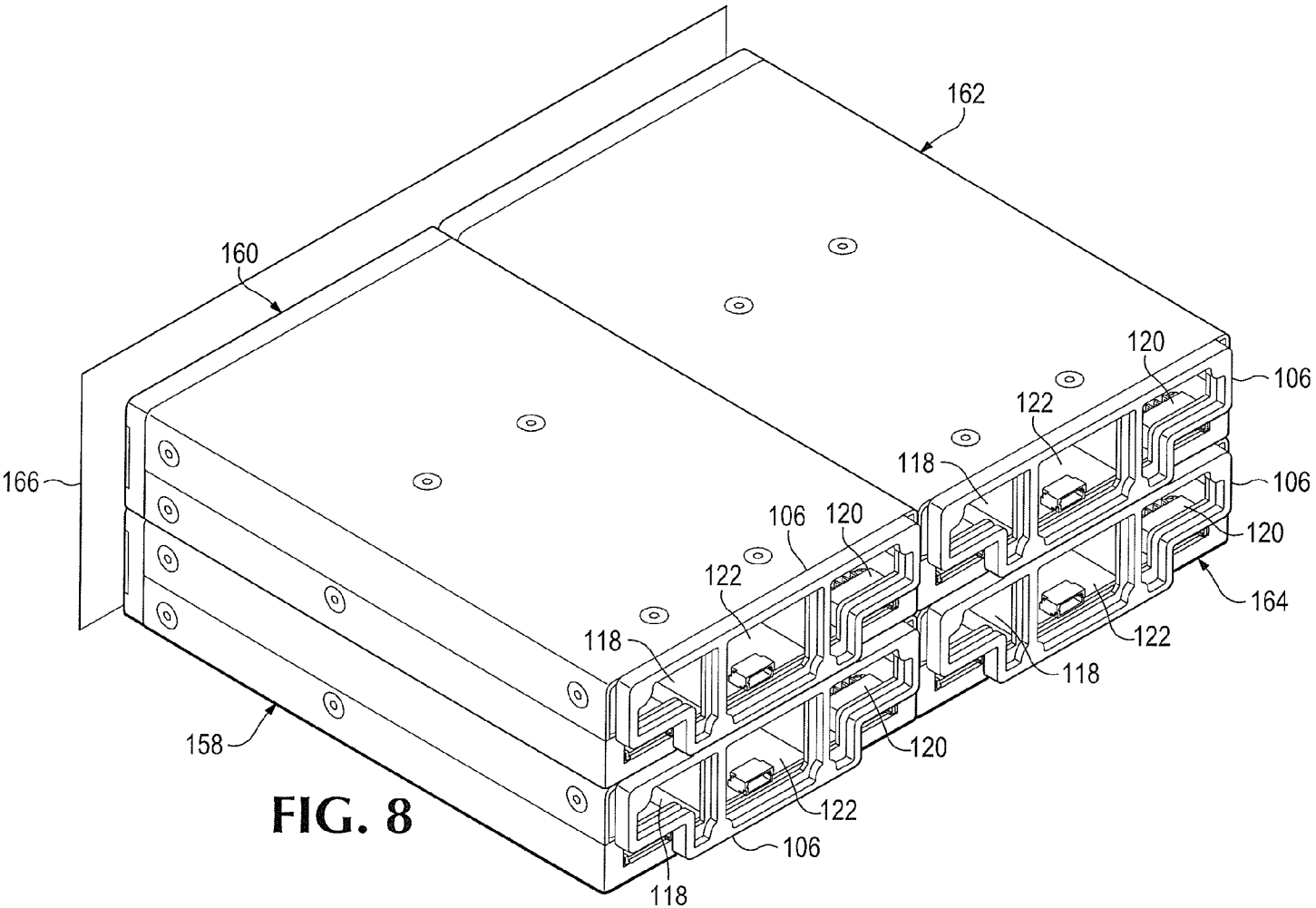
FIG. 8 shows a back perspective view of multiple lighting modules in a stacked configuration.

FIG. 8 shows a back perspective view of multiple lighting modules in a stacked configuration. Four lighting modules 158, 160, 162, 164 are shown stacked closely together both vertically and horizontally. The openings 118, 120, 122 of each of the lighting modules 158, 160, 162, and 164 are all positioned on the back surface 106 of their respective lighting modules. By positioning these openings 118, 120, 122 on the back surface 106 rather than any other surface of the lighting modules 158, 160, 162, 164, the lighting modules 158, 160, 162, 164 may be stacked in both a horizontal and a vertical direction without interfering with the ventilation systems of neighboring lighting modules. Any suitable number of lighting modules may be stacked in a vertical and/or a horizontal direction.

Light emitted from the lighting modules 158, 160, 162, 164 cures an item, such as ink, on a medium 166, as shown in FIG. 8. Because of the relative proximity within which the lighting modules 158, 160, 162, 164 can be positioned, light emitted from each of the lighting modules 158, 160, 162, 164 can cure a smaller, more concentrated area, which increases the efficiency and/or decreases the amount of time that the curing processes require. Further, because the lighting modules can be stacked in any suitable configuration, the curing process that takes place on the medium can be customized by shape, length, width, and the like, which produces a more accurate and efficient curing process.

Many elements of the disclosed lighting module allow for ease of cooling as compared to the more traditional lighting modules. Air is caused to enter a housing of a lighting module through an opening defined in an end of a channel and to flow through the channel into a light-emitting element portion of the housing. The light-emitting element portion of the housing may be a chamber divided from the channels in the housing by a divider such as a partition, wall, or the like, although some alternative configurations do not include a physical barrier. The light-emitting element portion of the housing contains an array of light-emitting elements and a heat sink that is arranged to remove heat generated when the array of light-emitting elements emit light. Air is also caused to enter the housing through a second opening that is defined in an end of a second channel. The second opening is positioned on a common plane with the other opening. The air entering the second channel flows through the second channel into the light-emitting element portion of the housing.

The air entering the lighting module through the first and second opening flows through the first and second channels and into the light-emitting element portion and is forced across the heat sink and through a third channel that is parallel with and positioned between the air intake channels. The air that is forced into the third channel is expelled through a third opening defined in an end of the third channel and positioned on the same plane as the openings to the air intake channels. The air entering the air intake channels, the first and second channels in this example, generally has a lower temperature than the air that is expelled through the third opening of the third channel. The common plane on which the three openings to the three channels are positioned is opposite of a plane through which the array of light-emitting elements emit light.

Many benefits of the disclosed lighting modules have been discussed. However, additional benefits not discussed herein will become apparent to one of skill in the art upon reading this disclosure. Also, some elements of the disclosed lighting modules may be replaced with suitable substitute elements. Although there have been described to this point particular embodiments for a method and apparatus for lighting modules and cooling a lighting module, it is not intended that such specific references be considered as limitations upon the scope of this invention except in-so-far as set forth in the following claims.

What is claimed is:

1. A lighting module, comprising:

a housing defining a first channel and a parallel, second channel, the housing including:

a first opening at a first end of the first channel, wherein the first opening is positioned on a first plane; and a second opening at a first end of the second channel, the second opening positioned on the first plane;

an intake fan positioned within the first channel, the intake fan structured to cause air to enter the first channel through the first opening;

an exhaust fan positioned within the second channel, the exhaust fan arranged to force air out of the second channel through the second opening; and an array of light-emitting elements positioned within the housing, wherein the first channel is separated from the second channel by a partition.

2. The lighting module of claim 1, wherein the first channel and the second channel are positioned adjacent to each other.

3. The lighting module of claim 1, wherein the first plane is opposite a second plane defined in the housing, wherein the array of light-emitting elements emit light from the housing through the second plane.

4. The lighting module of claim 1, wherein the intake fan and the exhaust fan are aligned with each other.

5. The lighting module of claim 1, wherein the intake fan is offset from the exhaust fan.

6. The lighting module of claim 1, wherein the housing further defines a third channel and a third opening positioned at a first end of the third channel and along the first plane, the third channel parallel with both the first channel and the second channel.

7. The lighting module of claim 6, wherein the second channel is positioned between the first channel and the third channel.

8. The lighting module of claim 7, further comprising a first baffle positioned between the first opening and the second opening on the first plane and a second baffle positioned between the second opening and the third opening on the first plane.

9. The lighting module of claim 7, further comprising a second intake fan positioned within the third channel and structured to cause air to enter the third channel through the third opening.

10. The lighting module of claim 9, wherein the intake fan and the second intake fan are aligned with each other.

11. The lighting module of claim 10, wherein the exhaust fan is offset from the intake fan and the second intake fan.

12. The lighting module of claim 1, wherein the first channel has a first volume and the second channel has a second volume that is approximately equal to the first volume.

13. A lighting module, comprising:

a housing defining a first channel and a parallel, second channel, the housing including:

a first opening at a first end of the first channel, wherein the first opening is positioned on a first plane; and a second opening at a first end of the second channel, the second opening positioned on the first plane;

an intake fan positioned within the first channel, the intake fan structured to cause air to enter the first channel through the first opening;

an exhaust fan positioned within the second channel, the exhaust fan arranged to force air out of the second channel through the second opening;

an array of light-emitting elements positioned within the housing; and baffles positioned between the first opening and the second opening on the first plane.

14. The lighting module of claim 13, wherein the first channel and the second channel are positioned adjacent to each other.

15. The lighting module of claim 13, wherein the first plane is opposite a second plane defined in the housing, wherein the array of light-emitting elements emit light from the housing through the second plane, and wherein the intake fan is offset from the exhaust fan.

16. The lighting module of claim 13, wherein the housing further defines a third channel and a third opening positioned at a first end of the third channel and along the first plane, the third channel parallel with both the first channel and the second channel, wherein the second channel is positioned between the first channel and the third channel, and further comprising a first baffle positioned between the first opening and the second opening on the first plane and a second baffle positioned between the second opening and the third opening on the first plane.

17. The lighting module of claim 13, wherein the first channel has a first volume and the second channel has a second volume that is approximately equal to the first volume.

18. A lighting module, comprising:

a housing having a first portion and a second portion;

a heat sink and an array of light-emitting elements positioned within the first portion of the housing;

a first channel, second channel, and third channel defined within the second portion of the housing, each of the first channel, the second channel, and the third channel positioned parallel with each other and the second channel positioned between the first channel and the third channel;

a first opening defined in a first end of the first channel, a second opening defined in a first end of the second channel, and a third opening defined in a first end of the third channel, wherein the first opening, the second opening, and the third opening are on a common plane;

a first intake fan in the first channel spaced apart from the first opening and arranged to cause air to flow through the first opening and the first channel and into the first portion;

an exhaust fan in the second channel spaced apart from the second opening and arranged to cause air to flow from the first portion through the second channel and to be expelled from the second opening; and a second intake fan in the third channel spaced apart from the third opening and arranged to cause air to flow through the third opening and the third channel into the first portion.

19. The lighting module of claim 18, wherein the first intake fan and the second intake fan are aligned with each other and the exhaust fan is offset from the first intake fan and the second intake fan.

20. The lighting module of claim 18, wherein the plane common to the first opening, the second opening, and the third opening is opposite a plane on the housing through which light from the array of light-emitting elements is emitted.

* * * * *